US012569718B2

(12) United States Patent
Chung et al.

(10) Patent No.: US 12,569,718 B2
(45) Date of Patent: Mar. 10, 2026

(54) SWITCH ASSEMBLY FOR REGULATING ROTARY LOAD AND FITNESS BIKE COMPRISING THE SAME

(71) Applicant: LG ELECTRONICS INC., Seoul (KR)

(72) Inventors: Jai Whan Chung, Seoul (KR); Sunggyu Koh, Seoul (KR); Min Seok Kim, Seoul (KR); Jong Kyu Ju, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 99 days.

(21) Appl. No.: 18/716,005

(22) PCT Filed: Jun. 9, 2023

(86) PCT No.: PCT/KR2023/007963

§ 371 (c)(1),
(2) Date: Jun. 3, 2024

(87) PCT Pub. No.: WO2024/025140

PCT Pub. Date: Feb. 1, 2024

(65) Prior Publication Data

US 2025/0025745 A1 Jan. 23, 2025

(30) Foreign Application Priority Data

Jul. 25, 2022 (KR) ..... 10-2022-0091691

(51) Int. Cl.
*A63B 22/06* (2006.01)
*A63B 21/00* (2006.01)
(Continued)

(52) U.S. Cl.
CPC ..... *A63B 22/0605* (2013.01); *A63B 21/0052* (2013.01); *A63B 21/225* (2013.01);
(Continued)

(58) Field of Classification Search
CPC . A63B 21/0051; A63B 21/0052; A63B 21/15; A63B 21/225; A63B 21/4035;
(Continued)

(56) References Cited

U.S. PATENT DOCUMENTS 10,328,303 B2 * 6/2019 Frank ..... A63B 69/0057
10,398,933 B2 * 9/2019 Crist ..... A63B 22/0023
(Continued)

FOREIGN PATENT DOCUMENTS

CN 101901710 A 12/2010
CN 113694466 A 11/2021
(Continued)

*Primary Examiner* — Gary D Urbiel Goldner
(74) *Attorney, Agent, or Firm* — Birch, Stewart, Kolasch & Birch, LLP

(57) ABSTRACT

A rotary load level of a flywheel of a fitness bike is adjustable to increase or decrease based on a one-touch manipulation of a switch for regulating a rotary load to the flywheel in opposing directions. This makes it possible to reliably adjust the rotary load level without causing a change in a user's posture during a ride of the fitness bike and to gradually control the rotary load level of the flywheel of the fitness bike.

15 Claims, 8 Drawing Sheets

(51) Int. Cl.
*A63B 21/005* (2006.01)
*A63B 21/22* (2006.01)
*A63B 24/00* (2006.01)
*A63B 71/06* (2006.01)

(52) U.S. Cl.
CPC ..... *A63B 21/4035* (2015.10); *A63B 24/0087* (2013.01); *A63B 2071/0675* (2013.01)

(58) Field of Classification Search
CPC ..... A63B 22/0605; A63B 24/0087; A63B 2071/0675; H01H 21/12; H01H 21/22; H01H 21/36
See application file for complete search history.

(56) References Cited

U.S. PATENT DOCUMENTS

| | | | | |
|---|---|---|---|---|
| 10,888,736 | B2 * | 1/2021 | Fedriga | A63B 24/0087 |
| 11,141,619 | B2 | 10/2021 | Liu et al. | |
| 11,633,647 | B2 * | 4/2023 | Fedriga | A63B 24/0075 482/5 |
| 12,220,613 | B2 * | 2/2025 | Koh | A63B 21/225 |
| 2005/0221960 | A1 * | 10/2005 | Miyamaru | A63B 22/0605 482/8 |
| 2011/0118086 | A1 * | 5/2011 | Radow | A63B 21/00196 482/5 |
| 2020/0147449 | A1 | 5/2020 | Liu et al. | |
| 2020/0338383 | A1 | 10/2020 | Liu et al. | |
| 2025/0001238 | A1 * | 1/2025 | Hong | A63B 21/0051 |
| 2025/0010137 | A1 * | 1/2025 | Baek | A63B 24/0087 |
| 2025/0152998 | A1 * | 5/2025 | Kim | A63B 21/0052 |
| 2025/0177801 | A1 * | 6/2025 | Kim | A63B 24/0087 |

FOREIGN PATENT DOCUMENTS

| | | | | | |
|---|---|---|---|---|---|
| CN | 216169680 | U | | 4/2022 | |
| CN | 216755308 | U | | 6/2022 | |
| KR | 20120031415 | A | * | 4/2012 | B62K 23/06 |
| KR | 20170035760 | A | * | 3/2017 | A63B 22/00 |
| WO | WO 2017/136366 | A1 | | 8/2017 | |

* cited by examiner

[Fig. 1]
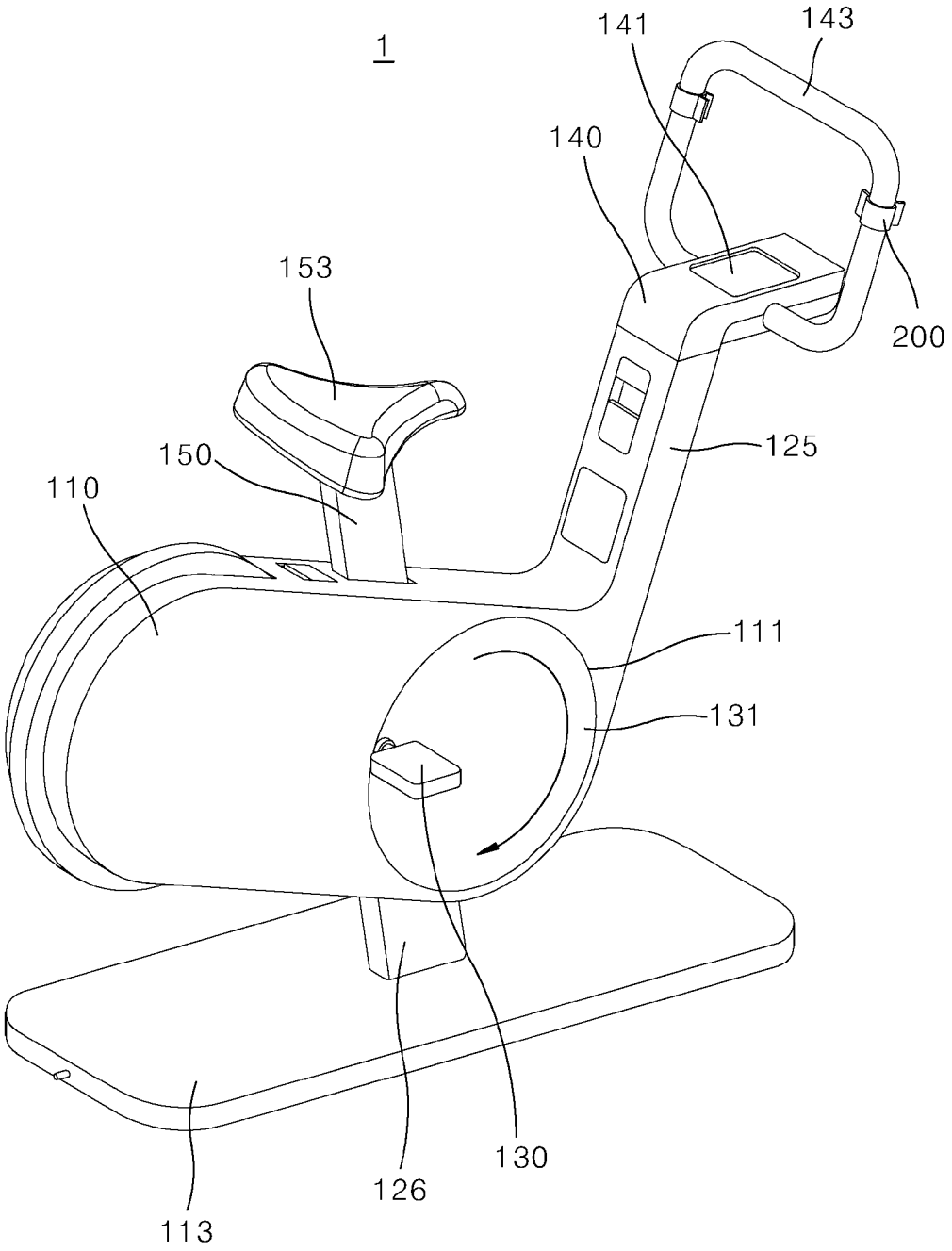

[Fig. 2]
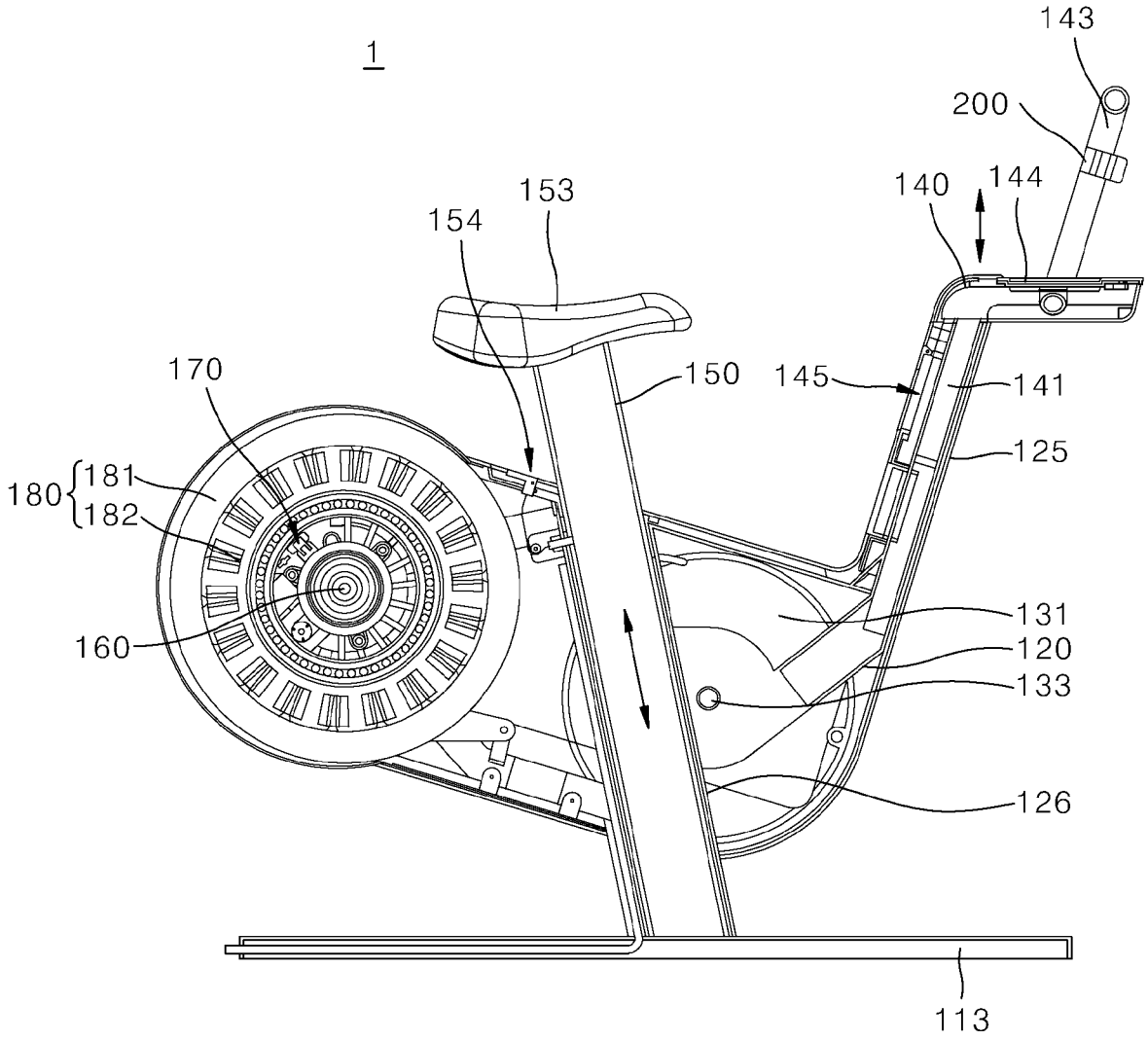

[Fig. 3]
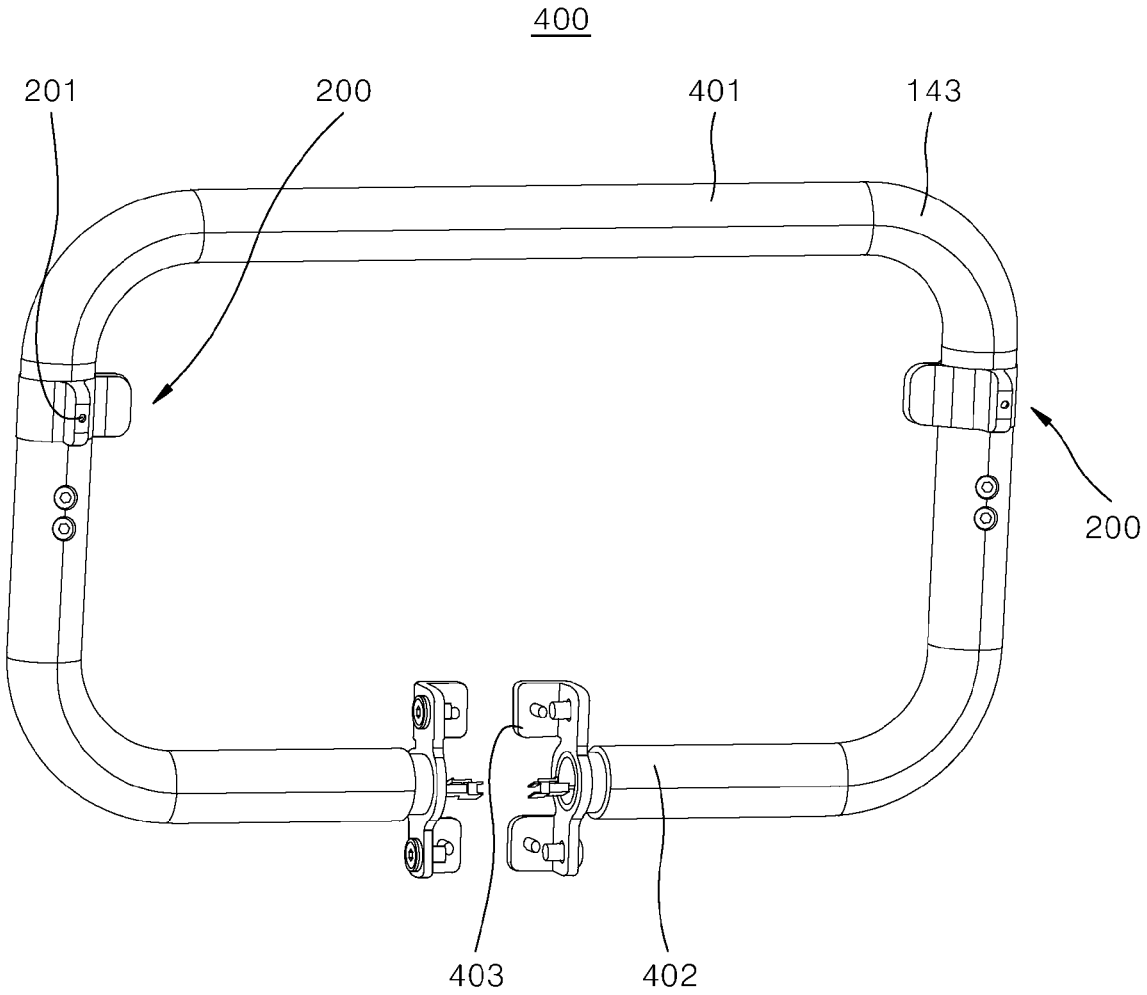
[Fig. 4]
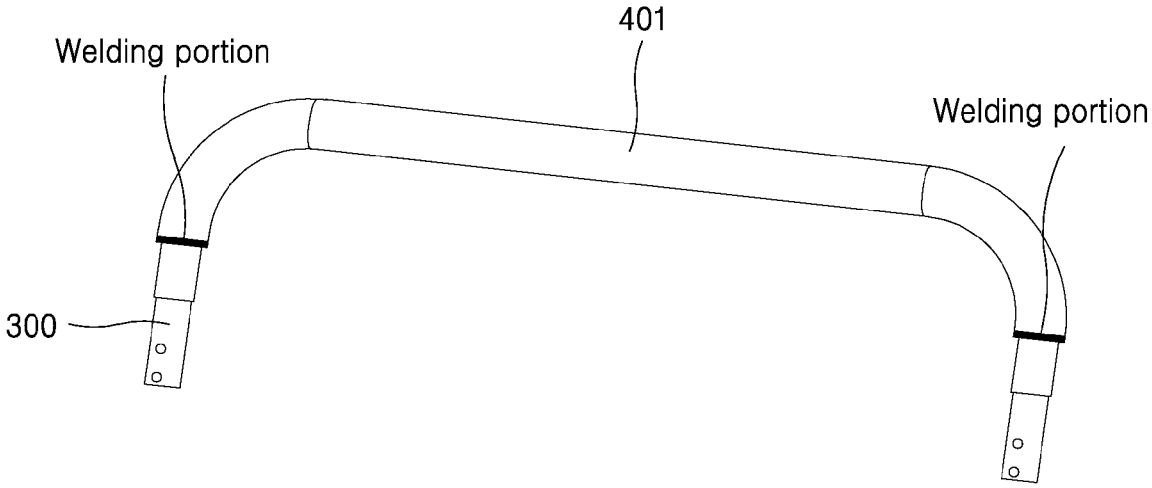

[Fig. 5]
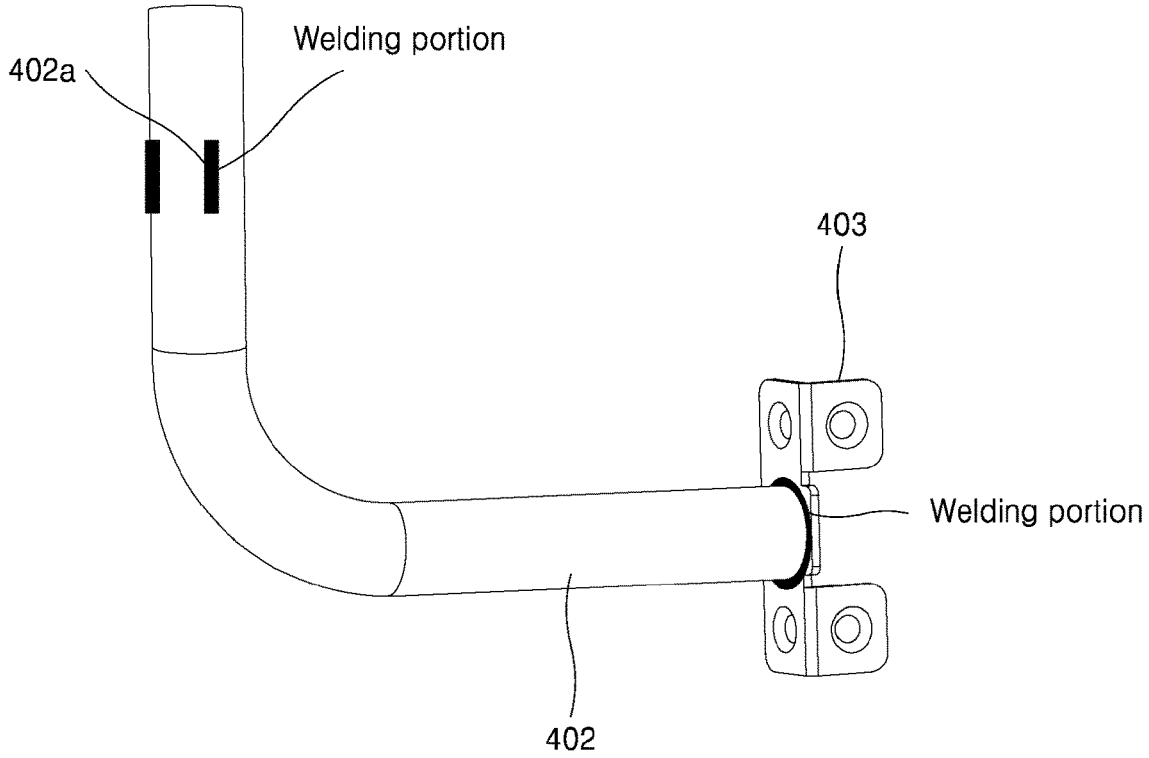
[Fig. 6]
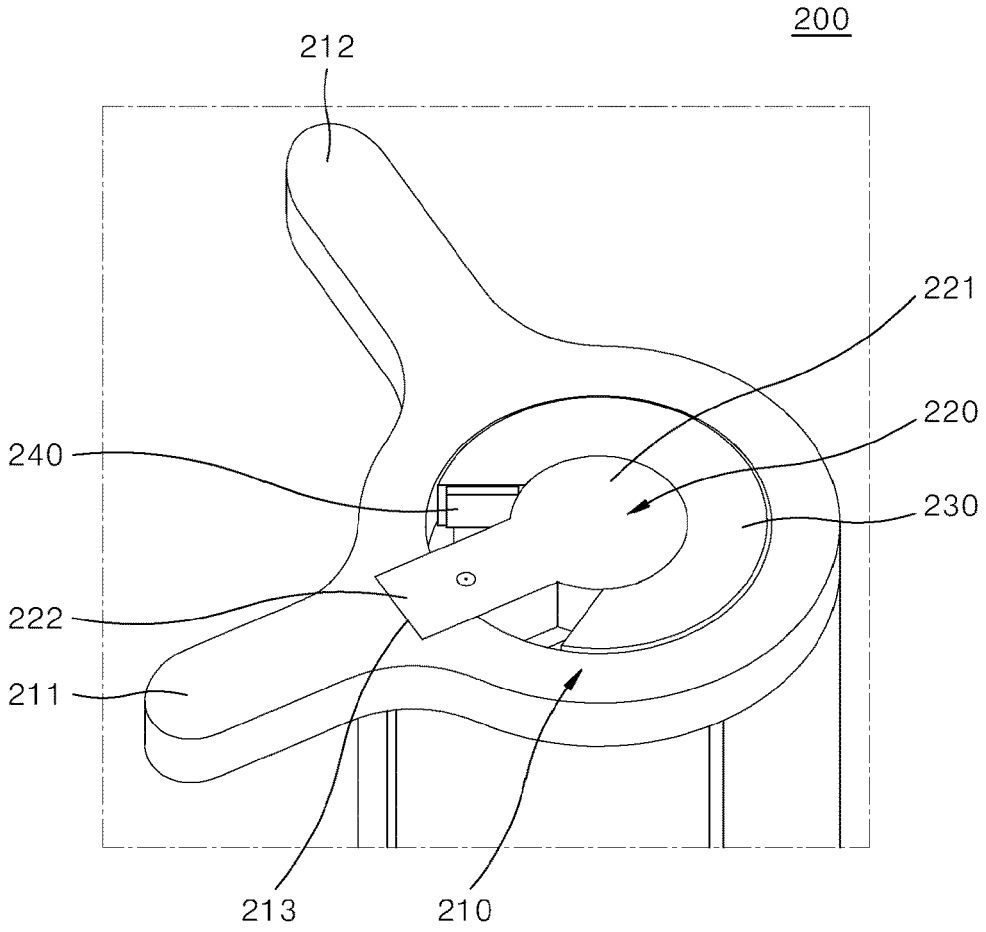

[Fig. 7]
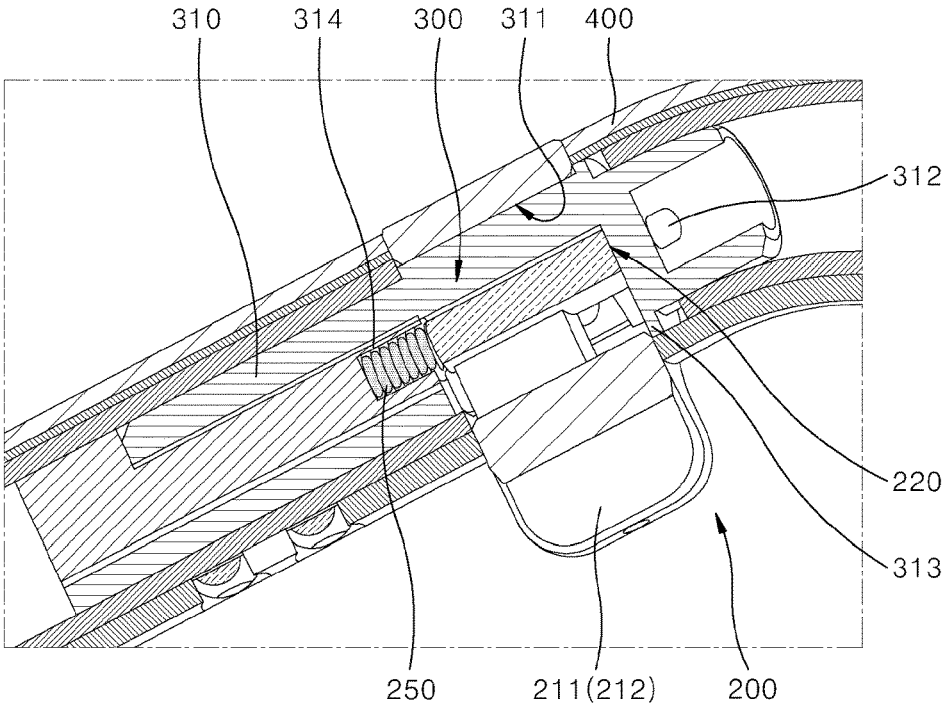
[Fig. 8]
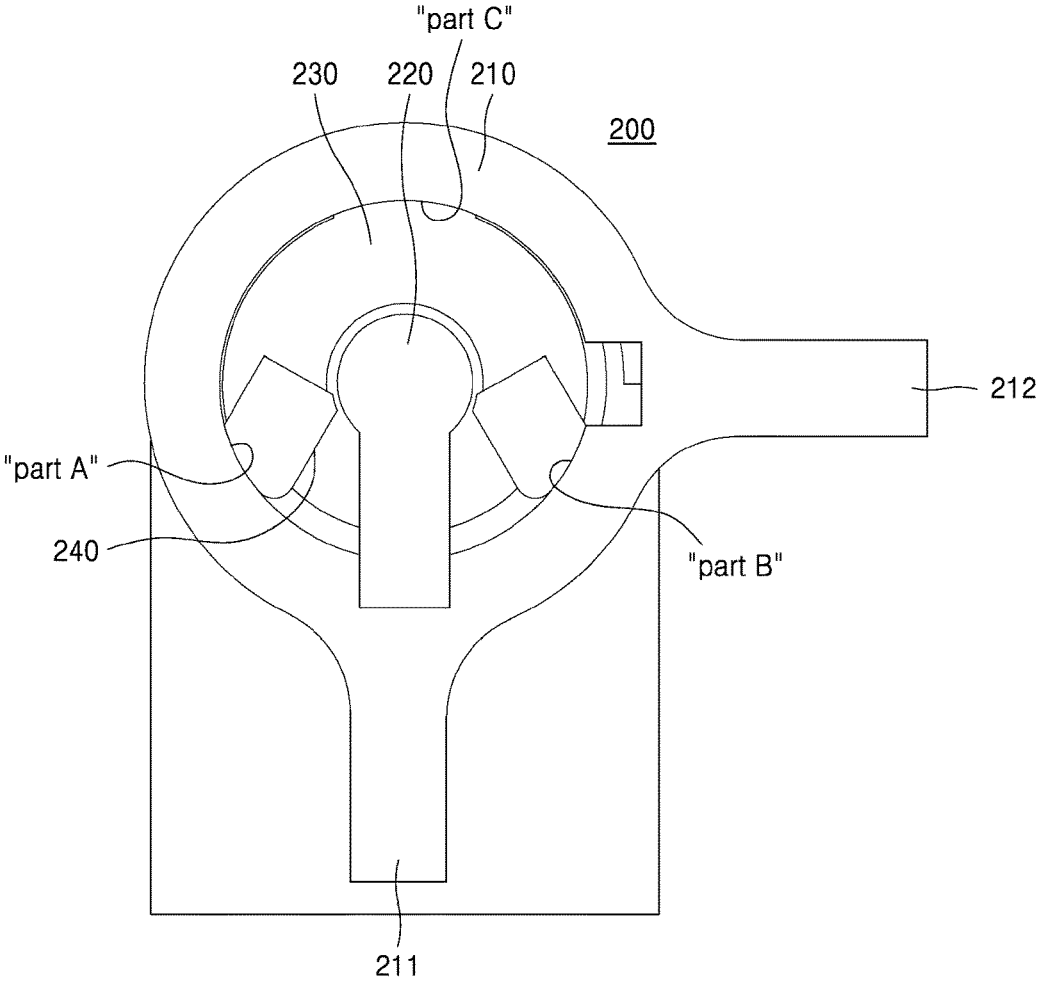

[Fig. 9]
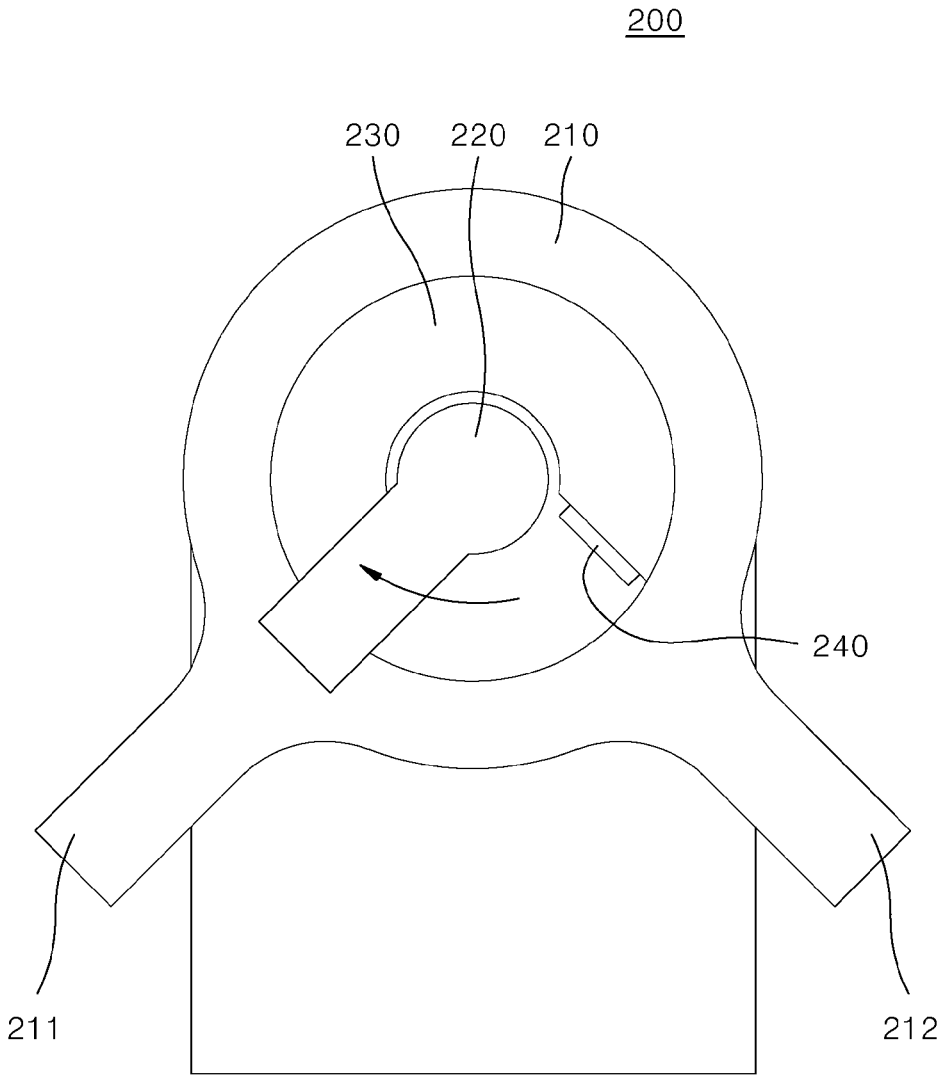

[Fig. 10]
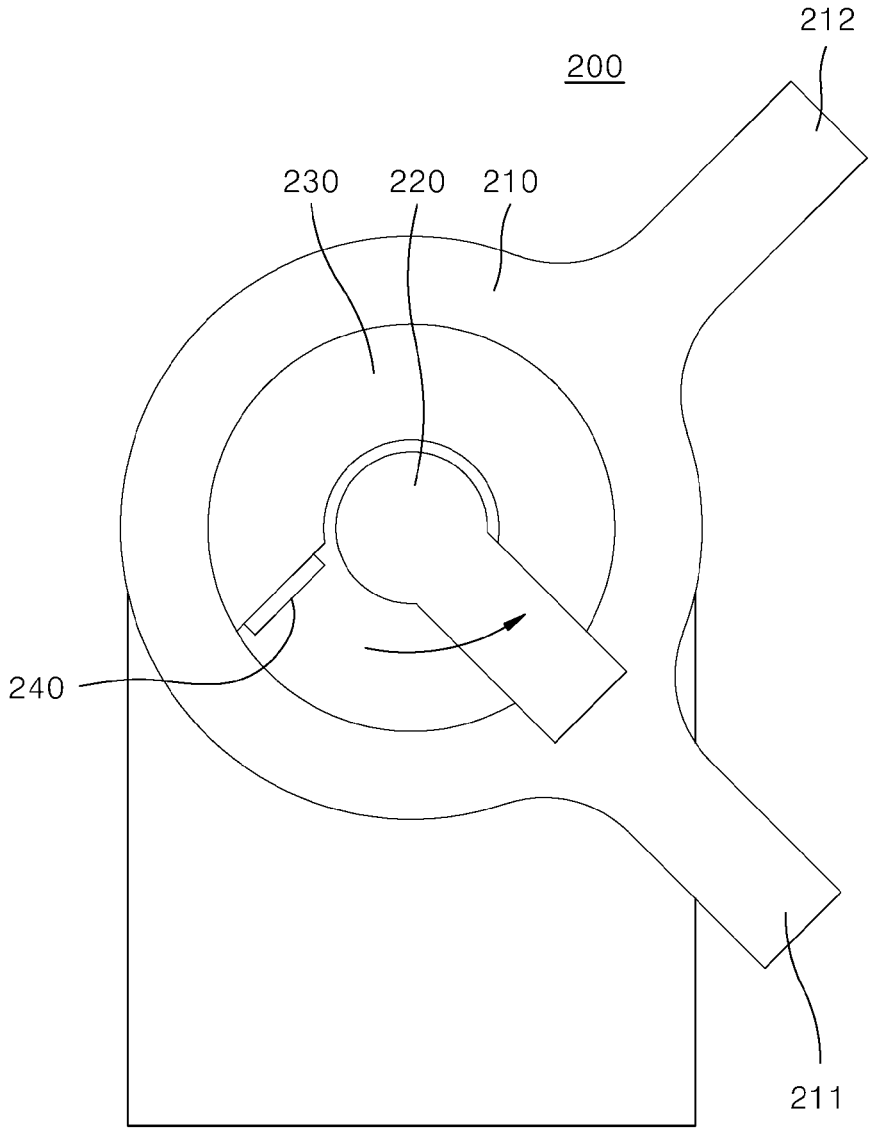
[Fig. 11]
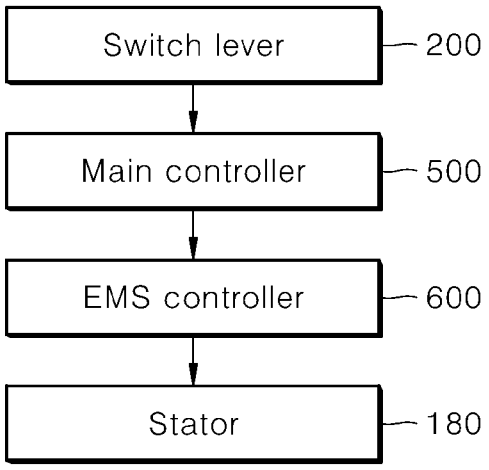

[Fig. 12]
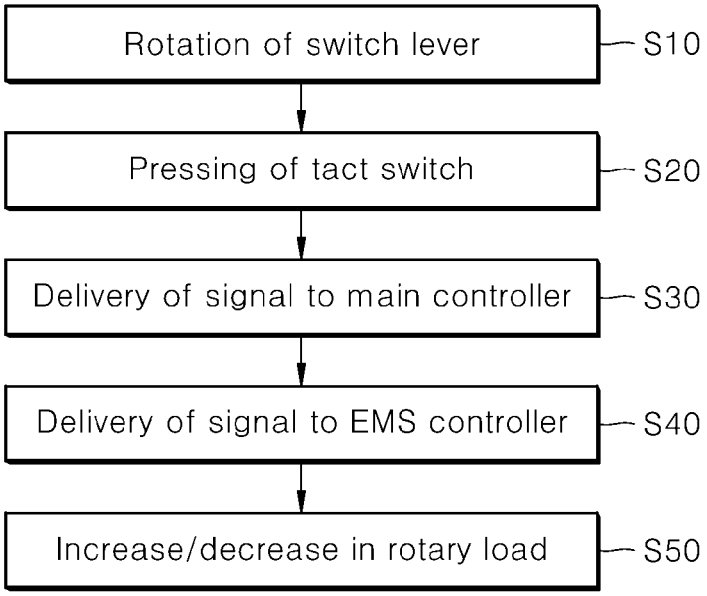

SWITCH ASSEMBLY FOR REGULATING ROTARY LOAD AND FITNESS BIKE COMPRISING THE SAME

CROSS REFERENCE TO RELATED APPLICATIONS

This application is the National Phase of PCT International Application No. PCT/KR2023/007963, filed on Jun. 9, 2023, which claims priority under 35 U.S.C. 119(a) to Patent Application No. 10-2022-0091691, filed in the Republic of Korea on Jul. 25, 2022, all of which are hereby expressly incorporated by reference into the present application.

TECHNICAL FIELD

The present disclosure relates to a switch assembly for regulating a rotary load, and in particular, a switch assembly for regulating a rotary load and a fitness bike comprising the same that can adjust a rotary load level applicable to a flywheel to a specific level, according to user taste preferences.

BACKGROUND ART

Fitness bikes are ordinarily used as indoor exercise equipment for building muscles. The wheels of a fitness bike rotate, as the user pedals, such that the user can exercise. Fitness bikes can be categorized into a spinning bike for spinning exercise and an indoor bike that allows the user to push pedals forward to rotate the pedals, like an ordinary bike.

In terms of pedaling-based exercise, a spinning bike adopts a non-freewheel structure, and an indoor bike adopts a freewheel structure.

In the non-freewheel structure applied to a spinning bike, power is transferred to wheels such that the wheels can rotate, in both cases where pedals rotate forward and where pedals rotate reversely.

Additionally, in the freewheel structure applied to an indoor bike, power is transferred to wheels only in the case where pedals rotate forward. However, power is not transferred to wheels in the case where pedals stop or rotate reversely.

A rotary load device of an exercise bike is disclosed in International Patent Publication No. WO2017/136366 (Aug. 10, 2017), and in the rotary load regulating device, magnetic resistance is applied to a rotation of a flywheel, to enable the user to pedal with intensity.

The rotary load device is ordinarily used together with a flywheel of an exercise bike. The rotary load device can selectively adjust a load applied to a flywheel to increase or decrease the load. For example, the user rotates a switch for regulating a rotary load, to allow a stator as a resistor comprising a fixation arm and a driving arm to increase or decrease a rotary load of the flywheel. The fixation arm ordinarily remains fixed to a frame part and the flywheel, and the diving arm increases or decreases a rotary load while moving along the circumference of the flywheel.

An existing switch for regulating a rotary load is coupled to the driving arm by a regulated load, and disposed on the frame part under a handle part. In the case where the user wants to adjust a rotary load of the flywheel if necessary, the user moves the user's hand gripping the handle part approximately to the height of the user's knees, at which a knob as a switch for regulating a rotary load is placed, to manipulate the knob.

At this time, since the user moves the user's hand toward the knob that is a bit far from the handle part, it is difficult for the user to manipulate the switch for regulating a rotary load while the user rides the exercise bike, the user's riding posture become unstable, and the user is likely to fall off the exercise bike.

DISCLOSURE OF INVENTION

Technical Problem

The objective of the present disclosure is to provide a switch assembly for regulating a rotary load and a fitness bike comprising a switch assembly for regulating a rotary load that can be manipulated by the user with the user's finger, in the state where the user grips a handle part, since a switch for regulating a rotary load is disposed on the handle part.

The objective of the present disclosure is to provide a switch assembly for regulating a rotary load and a fitness bike comprising a switch assembly for regulating a rotary load at which a rotary load level of a flywheel increases or decreases to be adjusted, based on a one-touch manipulation of a switch for regulating a rotary load in both directions.

The objective of the present disclosure is to provide a switch assembly for regulating a rotary load and a fitness bike comprising a switch assembly for regulating a rotary load at which a plurality of welding points is formed in the portion where the upper handle and the lower handle of the handle part are coupled to a switch for regulating a rotary load, ensuring rigidity of the handle part to which a large load is applied.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Solution to Problem

According to the present disclosure, a switch assembly for regulating a rotary load and a fitness bike comprising a switch assembly for regulating a rotary load, in an aspect, can be manipulated by the user with the user's finger, in the state where the user grips a handle part, since a switch for regulating a rotary load is disposed on the handle part.

Accordingly, the user can manipulate a rotary load level readily, in the state of gripping the handle part, during a ride exercise.

According to the present disclosure, a rotary load level of a flywheel can increase or decrease to be adjusted based on a one-touch manipulation in both directions.

According to the present disclosure, a plurality of welding points is formed in the portion where an upper handle and a lower handle of the handle part are coupled to the switch for regulating a rotary load, making it possible to ensure the rigidity of the handle part to which a large load is applied.

The device may be a switch assembly for regulating a rotary load that comprises a switch main body being rotatably assembled to a handle pipe, a rotating core part being concentric to the switch main body and rotating in a way that the rotating core part is elastically restored together with the switch main body, a fixation cover part supporting an inner lateral surface of the switch main body and an outer lateral surface of the rotating core part, and a tact switch part being disposed at both ends of the fixation cover part and switching based on a rotation of the rotating core part.

The switch main body may be rotatably coupled to the handle pipe in a circumferential direction thereof by a lever assemble that is inserted into a hollow hole of the handle pipe, and comprise a first manipulation part and a second manipulation part that protrude outward respectively within a predetermined angle range.

The rotating core part may comprise a swiveling shaft part having a circular cross section and being fixed to the shaft coupling part of the lever assembly, a pressing part being elongated from the swiveling shaft part and being supported by the switch main body, and en elastic member being disposed at a lower end of the swiveling shaft part of the rotating core part and exerting an elastic restoring force.

The switch assembly for regulating a rotary load according to the present disclosure may further comprise a main controller recognizing a pressing operation of the tact switch part as a signal for regulating a rotary load level of a flywheel, and delivering a driving signal to an EMS controller that drives a resistor increasing or decreasing a rotary load of the flywheel.

The EMS controller may determine whether a level of the rotary load of the flywheel increases or decreases, and based on an increase or a decrease in the rotary load of the flywheel, adjust intensity of a magnetic force of a stator as the resistor, and give a resistance value in relation to the rotary load to the flywheel.

Additionally, a fitness bike according to the present disclosure comprises a switch assembly for regulating a rotate load, provided with a switch lever that comprises a switch main body being rotatably assembled to a handle pipe and being provided with a first manipulation part and a second manipulation part that protrude outward respectively within a predetermined angle range, a rotating core part being concentric to the switch main body and rotating in a way that the rotating core part is elastically restored together with the switch main body, a fixation cover part supporting an inner lateral surface of the switch main body and supporting an outer lateral surface of the rotating core part, a tact switch part being disposed at both ends of the fixation cover part and switching based on a rotation of the rotating core part, and elastic member being disposed at a lower end of the rotating core part, and applying an elastic restoring force to the rotating core part.

The handle pipe may have a rectangle shape in a way that an upper handle of an inverted "U" shape, and each of lower handles of a "ㄴ" shape are combined.

The switch lever may be elongated in the direction where the first manipulation part and the second manipulation part of the switch main body face each other, at the handle pipe.

Advantageous Effects of Invention

In terms of the switch assembly for regulating a rotary load and the fitness bike comprising the switch assembly for regulating a rotary load, according to the present disclosure, the user may readily manipulate a rotary load level in the state where the user grips the handle part, during a ride exercise, while the user's hands are prevented from escaping from the handle part, since a switch for regulating a rotary load is disposed on the handle part.

According to the present disclosure, a rotary load level of the flywheel may increase or decrease to be adjusted based on a one-touch manipulation of the switch for regulating a rotary load in both directions, making it possible to gradually increase or decrease a rotary load of the flywheel.

According to the present disclosure, a plurality of welding points may be formed in the portion where the upper handle and the lower handle of the handle part are coupled to the switch for regulating a rotary load, making it possible to ensure the rigidity of the handle part provided with the switch for regulating a rotary load to which a large load is applied.

According to the present disclosure, the first manipulation part and the second manipulation part of the switch main body are elongated in the direction where the first manipulation part and the second manipulation part face each other, at the handle pipe, making it possible for the user to manipulate the first and second manipulation parts readily with the user's finger in both directions, in the state where the user grips the handle part under the switch lever.

According to the present direction, a fastening tool of the switch lever, coupled to the handle part, is not in the user's vision at a maximum level, making it possible to improve the exterior of the fitness bike and a level of completion in design of the fitness bike.

Specific effects are described along with the above-described effects in the section of detailed description.

BRIEF DESCRIPTION OF DRAWINGS

FIG. 1 is a perspective view schematically showing a fitness bike at which a switch assembly for regulating a rotary load in an embodiment is disposed.

FIG. 2 is a side view schematically showing the inner structure of the fitness bike of FIG. 1.

FIG. 3 is a perspective view showing a state in which the switch assembly for regulating a rotary load of a fitness bike in an embodiment is installed.

FIG. 4 is a perspective view showing the welding portion of an upper handle of a handle part of FIG. 3.

FIG. 5 is a perspective view showing the welding portion of a lower handle of the handle part of FIG. 3.

FIG. 6 is a perspective view schematically showing a switch for regulating a rotary load in an embodiment.

FIG. 7 is a cross-sectional view schematically showing a switch assembly for regulating a rotary load, installed in a handle part in an embodiment.

FIG. 8 is a planar cross-sectional view schematically showing a switch for regulating a rotary load in an embodiment.

FIGS. 9 and 10 are plan views showing an operation state of the switching assembly for regulating a rotary load of the fitness bike in FIG. 6.

FIG. 11 is a block diagram showing the configuration of control of a rotation resistance device of a fitness bike in an embodiment.

FIG. 12 is a flowchart showing a control method of a rotation resistance device of a fitness bike in an embodiment.

BEST MODE FOR CARRYING OUT THE INVENTION

Hereafter, preferred embodiments of the present disclosure are described with reference to the accompanying drawings.

Embodiments are not limited to the embodiments set forth herein, and can be modified and changed in various different forms. The embodiments in the disclosure are provided such that the disclosure can be through and complete and fully convey its scope of to one having ordinary skill in the art. Accordingly, all modifications, equivalents or replacements as well as a replacement of the configuration of any one embodiment with the configuration of another embodiment or an addition of the configuration of any one embodiment to the configuration of another embodiment, within the technical spirit and scope of the disclosure, are to be included in the scope of the disclosure.

The accompanying drawings are provided for a better understanding of the embodiments set forth herein and are not intended to limit the technical spirit of the disclosure. It is to be understood that all the modifications, equivalents or replacements within the spirit and technical scope of the disclosure are included in the scope of the disclosure. The sizes or thicknesses of the components in the drawings are exaggerated or reduced to ensure case of understanding and the like. However, the protection scope of the subject matter of the disclosure is not to be interpreted in a limited way.

The terms in the disclosure are used only to describe specific embodiments and not intended to limit the subject matter of the disclosure. In the disclosure, singular forms include plural forms as well, unless explicitly indicated otherwise. In the disclosure, the terms "comprise", "being comprised of" and the like specify the presence of stated features, integers, steps, operations, elements, components or combinations thereof but do not imply the exclusion of the presence or addition of one or more other features, integers, steps, operations, elements, components or combinations thereof.

The terms "first", "second" and the like are used herein only to distinguish one component from another component. Thus, the components are not to be limited by the terms.

When any one component is described as being "connected" or "coupled" to another component, any one component can be directly connected or coupled to another component, but an additional component can be "interposed" between the two components or the two components can be "connected" or "coupled" by an additional component. When any one component is described as "being directly connected" or "being directly coupled" to another component, an additional component cannot be "interposed" between the two components or the two components cannot be "connected" or "coupled" by an additional component.

When any one component is described as being "on (or under)" another component, any one component can be directly on (or under) another component, and an additional component can be interposed between the two components.

Unless otherwise defined, all the terms including technical or science terms used herein have the same meaning as commonly understood by one having ordinary skill in the art. Additionally, terms such as those defined in commonly used dictionaries are to be interpreted as having a meaning that is consistent with their meaning in the context of the relevant art, and unless explicitly defined herein, are not to be interpreted in an ideal way or an overly formal way.

Hereafter, a fitness bike in which a switch assembly for regulating a rotary load in an embodiment is installed is described.

FIG. 1 is a perspective view schematically showing a fitness bike at which a switch assembly for regulating a rotary load according to the present disclosure is disposed, and FIG. 2 is a side view schematically showing the inner structure of the fitness bike of FIG. 1.

Referring to FIGS. 1 and 2, in the case of a fitness bike 1 in the embodiment, the height of a handle part 143 may be regulated to correspond to the body shape of the user. The fitness bike 1 comprises a frame part 120, a spacer part 125, a stem 140, a seat housing part 126, a seat post 150, a stem locking part 145, and a post locking part 154.

A base part 113 is disposed at the lower side of the frame part 120, to support the frame part 120. The base part 113 may be formed into a rectangular plate that connects to the lower side of the frame part 120. The base part 113 may be modified in various different forms.

The frame part 120 supports a driving shaft part 133 and a rotating shaft part 160. The frame part 120 may have various structures, depending on the load distribution and the structure of the fitness bike 1.

A casing 110 is provided to cover the outer side of the frame part 120. The frame part 120, a flywheel 170, a brake device (not illustrated), a rotation resistance device (not illustrated) and the like are installed in the casing 110. The front side and the rear side of the casing 110 may be rounded, and both sides of the casing 110 in the left-right direction may be shaped into a flat plate. A circular disc hole part 111 is formed at both sides of the casing 110 in the left-right direction.

A rotating disc 131 is installed in the disc hole part 111. The rotating disc 131 is shaped into a circular panel. The casing 110 and the rotating disc 131 shield the frame part 120, the flywheel 170 and the like from the outside. Accordingly, the casing 110 and the rotating disc 131 may prevent the user and an animal from approaching to the rotating disc, there eliminating the risk of injuries. Additionally, the casing 110 and the rotating disc 131 may prevent foreign substances from being attached to components such as the frame part 120, the flywheel 170 and the like. The casing 110 forms the exterior of the fitness bike 1.

The central portion of the rotating disc 131 connects to both sides of the driving shaft part 133. A pedal 130 connects respectively to the circumference of each rotating disc 131. A pedal 130 of the rotating disc 131 is disposed respectively at one side of the driving shaft part 133 and at the other side of the driving shaft part 133 in the direction of the outer side of the driving shaft part 133. As the user pushes the pedals 130, the rotating disc 131 rotates around the driving shaft part 133.

The driving shaft part 133 is installed in a way that penetrates the central portion of a driving wheel (not illustrated). The driving shaft part 133 and the rotating shaft part 160 are connected by a power transfer part (not illustrated) such as a belt or a chain. As the user pushes the pedals 130, the rotating disc 131 rotates. As the rotating disc 131 rotates, the driving shaft part 133 and the rotating shaft part 160 rotate.

Since the rotating disc 131 shields the disc hole part 111, the user or an infant can be protected from injuries, even in the case where the pedals 130 are pushed and the rotating disc 131 rotates. Additionally, the rotating disc 131 shields the driving shaft part 133, the diving wheel (not illustrated) and the like, to prevent the components inside the fitness bike 1 from being exposed to the outside. Thus, a body part of the user or an animal and the like may be prevented from coming into the casing 110.

The spacer part 125 is elongated upward, at the front side of the casing 110. The spacer part 125 is supported by the frame part 120. The spacer part 125 is formed in a way that the inside of the spacer part 125 is vacant to allow the stem 140 to be coupled to the spacer part 125.

The stem 140 comprises a stem post 141 that is coupled to the spacer part 125 in a way that the height of the stem 140 is adjustable. A display part 144 may be disposed at the upper side of the stem 140. The display part 144 may output exercise information such as the speed, rotary load and the like of the fitness bike 1. The stem 140 may be coupled to the spacer part 125 in a way that the height of the stem 140 is adjustable. A handle part 143 connects to the upper side of the stem 123.

Since the upper side of the spacer part 125 is disposed to incline further forward than the lower side of the spacer part 125. As the height of the stem 140 increases, the handle part 143 becomes farther from the the user. Accordingly, the height of the handle part 143 is adjusted for a tall user, such that the height and the front-rear distance of the handle part 143 are adjusted properly to correspond to the height of the user.

A seat housing part 126 is installed in the casing 110. The seat housing part 126 may be installed in a way that passes through the casing 110. The seat housing part 126 may be disposed to incline in the up-down direction of the casing 110. The seat housing part 126 is disposed between the driving shaft part 133 and the rotating shaft part 160. The seat housing part 126 may have various shapes such as a polygonal pipe or a circular pipe and the like.

The seat post 150 is coupled to the inside of the seat housing part 126 in a way that the height of the seat post 150 is adjustable. The upper end portion of the seat post 150 is disposed to incline further rearward than the lower end portion of the seat post 150. A seat 153 on which the user sits is disposed at the upper side of the seat post 150. The seat post 150 may be installed inside the seat housing part 126 in a way that the height of the seat post 150 is adjustable. The cross section of the seat post 150 may vary depending on the shape of the seat housing part 126.

Since the seat post 150 and the seat housing part 126 are disposed to incline in the up-down direction, as the height of the seat post 150 increases, the seat 153 becomes far from the handle part 143. Thus, as the height of the seat post 150 increases for a tall user, the heights of the seat 53 and the handle part 143 and the front-rear distance between the seat 153 and the handle part 143 may be adjusted properly, to correspond to the height of the user.

The flywheel 170 is shaft-coupled to the rotating shaft part 160. The rotating shaft part 160 is coupled to the rotation center of the flywheel 170, and the rotating shaft part 160 and the flywheel 170 are connected by a one-way bearing (not illustrated) as a medium. The one-way bearing is disposed in a way that the rotating shaft part 160 and the flywheel 170 are concentric. Additionally, the rotating shaft part 160 and the flywheel 170 may be limited or released by a clutch gear module (not illustrated). The clutch gear module may also be disposed in a way the clutch gear module is concentric to the rotating shaft part 160 and the flywheel 170.

Additionally, in terms of the fitness bike 1 of the present disclosure, the flywheel 170 may be disposed at the rear side or the front side with respect to the driving shaft part 133. Depending on the position in which the flywheel 170 is disposed, the shapes of the frame part 120 and the casing 110 change. Further, the positions of the driving shaft part 133 and the rotating shaft part 160 also change.

Furthermore, the flywheel 170 rotates in a freewheel mode or a non-freewheel mode.

In the freewheel mode, the flywheel 170 rotates based on the binding force of the one-way bearing, in the case where the rotating shaft part 160 rotates forward, and the flywheel 170 does not rotate, in the case where the rotating shaft part 160 rotates reversely. In the freewheel mode, the rotating shaft part 160 idles at the flywheel 170 in the case where the rotating shaft part 160 rotates reversely.

In the non-freewheel mode, the flywheel 170 rotates, in the case where the rotating shaft part 160 rotates forward or reversely. In the non-freewheel mode, the rotating shaft part 160 and the flywheel 170 are locked to each other by the clutch gear module and rotate together.

A stator 180 is disposed at the frame part 120 such that the stator 180 applies a magnetic force to the flywheel 170 to regulate the rotary load of the flywheel 170. The stator 180 is an electromagnet where a coil 182 is wound around an iron core 181. As a power source is supplied to the coil 182, a magnetic force is generated by the stator 180. The current that is supplied to the coil 182 of the stator 180 is adjusted such that the intensity of the magnetic force of the stator 180 may be adjusted.

As the rotary load (the intensity of the magnetic force of the stator 180) of the flywheel 170 increases, a pedal effort of pushing the pedals 130, i.e., a rotary load, increases, and as the rotary load (the intensity of the magnetic force of the stator 180) of the flywheel 170 decreases, a pedal effort of pushing the pedals 130, i.e., a rotary load, decreases. Accordingly, the intensity of the magnetic force of the stator 180 is adjusted to adjust the rotary load of the flywheel 170, thereby adjusting the pedal load of the user.

FIG. 3 is a perspective view showing a state in which the switch assembly for regulating a rotary load of a fitness bike in an embodiment is installed, FIG. 4 is a perspective view showing the welding portion of an upper handle of a handle part of FIG. 3, and FIG. 5 is a perspective view showing the welding portion of a lower handle of the handle part of FIG. 3.

As shown in the drawing, the handle part 143 is comprised of a handle grip (not illustrated) and a handle pipe 400. The handle pipe 400 has a rectangle shape in a way that an upper handle 401 having an inverted "U" shape and each of lower handles 402 having a "ㄴ" shape are combined. The curved parts of the upper handle 401 and the lower handle 402 of the handle pipe 400 are rounded at a constant R value. A fixation bracket 403, welded and fixed to the lower handle 402 based on welding, may be connected and coupled to the stem 140 of the fitness bike 1.

A switch for regulating a rotary load for regulating a rotary load level of the flywheel 170 is disposed at a portion where the upper handle 401 and the lower handle 402 connect.

The switch for regulating a rotary load comprises a switch lever 200 that can be manipulated in both directions including the clockwise direction and the counterclockwise direction, with respect to the handle pipe 400 as an axis. The switch for regulating a rotary load may regulate the rotary load level of the flywheel 170 in the state where the user grips the handle part 143 and the position of the user's hand does not escape from the handle part 143.

As shown in FIGS. 4 and 5, together with a lever assembly 300, the switch lever 200 is welded and fixed along the circumferential surface of the upper handle 401 of the handle pipe 400, in the end portions of both sides of the upper handle 201, based on welding, and is welded and fixed along a plurality of slit holes **402*a* that is formed at the lower handle 402 in the longwise direction, based on welding, in the state where the lever assembly 300 is inserted into the lower handle 402. At this time, the switch lever 200 may obtain a welding portion corresponding to a predetermined length (about 8 mm), in the lower portions of the curved parts of the upper handle 401, considering the welding of the handle pipe 400**.

Since a plurality of welding points are formed in the portion where the upper handle 401 and the lower handle 402 of the handle part 143 are coupled to the switch lever 200 as described above, the rigidity of the handle part 143 provided with the switch lever 200 to which a large load is applied may be ensured.

As illustrated in FIG. 3, in terms of the switch lever 200, a first manipulation part 211 and a second manipulation part 212 of a switch main body 210 described hereafter are elongated in mutually facing directions of the handle pipe 400. Accordingly, the user may manipulate the switch lever 200 easily in both directions, i.e., in the clockwise direction and the counterclockwise direction, with the user's finger, in particular, the user's thumb, in the state where the user grips the handle part 143 under the switch lever 200.

FIG. 3 is a perspective view showing that the handle part 143 of the fitness bike in the embodiment is viewed from below, and in terms of the switch lever 200, a fastening tool 201 such as a screw and the like is fastened to a fastening hole at any one of the first manipulation part 211 and the second manipulation part 212 of the switch main body 210. At this time, the fastening tool 201 fastened to the fastening hole may be formed under any one of the first manipulation part 211 and the second manipulation part 212 of the switch main body 210, which is elongated downward, such that the fastening tool 201 is not in the view of the user to a maximum degree. Thus, the exterior of the fitness bike 1 and the completion level in design may improve.

FIG. 6 is a perspective view schematically showing a switch for regulating a rotary load in an embodiment, FIG. 7 is a cross-sectional view schematically showing a switch assembly for regulating a rotary load, installed in a handle part in an embodiment, and FIG. 8 is a planar cross-sectional view schematically showing a switch for regulating a rotary load in an embodiment.

As shown in the drawing, the switch lever 200 comprises a switch main body 210 that is rotatably assembled to the lever assembly 300 installed in the hollow hole of the handle pipe 400.

The lever assembly 300 is a support structure that is inserted into the hollow hole of the handle pipe 400 and supports the switch lever 200, and has an assembly space in which components and electrical components (electronic components) of the switch lever 200 can sit.

Specifically, the lever assembly 300 comprises an assembly main body 310 that is inserted into the hollow hole of the handle pipe 400.

The assembly main body 310 of the lever assembly 300 comprises an insertion groove part 311 into which the switch main body 210 of the switch lever 200 is inserted and which is formed concavely along the circumferential direction of the assembly main body 310, and a shaft coupling part 312 which is shaft-coupled to a rotating core part 220 to allow the switch main body 210 to rotate along the insertion groove part 311.

The assembly main body 310 comprises a coupling part 313 to be fixed in the hollow hole of the handle pipe 400 without escaping from the hollow hole of the handle pipe 400. The switch main body 210 of the switch lever 200 is inserted closely into the insertion groove part 311 of the assembly main body 310 and rotates without a gap. The assembly main body 310 comprises a mounting groove part 314 on which an elastic member 250 is mounted, at the center of the lower portion of the insertion groove part 311.

Additionally, the switch lever 200 comprises a switch main body 210, a rotating core part 220, a fixation cover part 230, and a tact switch part 240.

The switch main body 210 may be inserted closely into the insertion groove part 311 of the lever assembly 300. The switch main body 210 is rotatably shaft-fixed by the shaft coupling part 312 of the lever assembly 300. The switch main body 210 may comprise a first manipulation part 211 and a second manipulation part 212 that protrude in the outward direction, respectively within a predetermined angle range and within an approximate 90-degree range.

The surfaces of the first manipulation part 211 and the second manipulation part 212, contacting the user's thumb, are shaped into a flat surface, such that the user may manipulate the first manipulation part 211 and the second manipulation part 212 with the user's thumb.

The rotating core part 220 comprises a swiveling shaft part 221 being fixed by the shaft coupling part 312 of the lever assembly 300 and having a circular cross section, and a pressing part 222 being elongated from the swiveling shaft part 221 and being supported by the switch main body 210.

The swiveling shaft part 221 is shaft-coupled to the assembly main body 310 of the lever assembly 300 by the shaft coupling part 312, is formed at the center of the switch main body 210 and is concentric to the switch main body 210, and is connected with the elastic member 250 and exerts an elastic restoring force. In the embodiment, the elastic member 250 may be a torsion spring to which a twisting elastic force is applied and returns to a state where the torsion spring is not twisted.

The elastic member 250 comprises a coil-type elastic part (not illustrated) that is inserted into the swiveling shaft part 221 of the rotating core part 220, a first support part (not illustrated) that is elongated to one side of the elastic part and is supported by the rotating core part 220 rotatably coupled onto the fixation cover part 230, and a second support part (not illustrated) that is elongated to the other side of the elastic part and is supported by the lever assembly 300.

The elastic member 250 applies an elastic force in a direction opposite to the rotation direction of the switch main body 210, in the state where the second support part at the other side of the elastic member 250 is elastically supported by the lever assembly 300, at the same time as the first support part at one side of the elastic member 250 elastically supports the switch main body 210.

The elastic member 250, in the embodiment, is restricted to a torsion spring, but not limited. The elastic member 250 may be modified to various restoring springs and the like, considering a connection relationship and an operation relationship between the switch lever 200 and the lever assembly 300.

The pressing part 222 may be inserted into and supported by a recessed portion 213 that is concavely formed at the switch main body 210.

Accordingly, the rotating core part 220 comprising the swiveling shaft part 221 and the pressing part 222 can rotate around the swiveling shaft part 221, in the clockwise direction and the counterclockwise direction, together with the switch man body 210.

A fixation cover part 230 having a circular arc shape is disposed between the switch main body 210 and the rotating core part 220. The fixation cover part 230 has a circular arc shape in a way that the outer lateral surface of the fixation cover part 230 supports and closely contacts the inner lateral surface of the switch main body 210, and the inner lateral surface of the fixation cover part 230 supports and closely contacts the outer lateral surface of the swiveling shaft part 221 of the rotating core part 220, to ensure a smooth rotation.

A tact switch part 240 is disposed on the surfaces of both ends of the fixation cover part 230. The tact switch part 240 switches based on a pressing operation of the pressing part 222, while the pressing part 222 of the rotating core part 220 rotates. The pressing operation is a one-touch operation, i.e., a press that is performed on the tact switch part 240 once by the pressing part 22 while the pressing part 222 rotates, rather than being performed multiple times on the tact switch part 240, to control a level of the rotary load of the flywheel 170, in stages. That is, in the case where the first manipulation part 211 and the second manipulation part 212 of the switch main body 210 are manipulated to allow the pressing part 222 of the rotating core part 220 to press the tact switch part 240, the elastic member 250 connecting to the rotating core part 220 applies an elastic restoring force, and the rotating core part 220 and the switch main body 210 return to an original state, to perform the one-touch operation.

As illustrated in FIG. 8, the support surfaces (part A and part B) of the tact switch part 240, supporting the inner lateral surface of the switch main body 210, are formed to have a minimum gap in the radial direction. That is, a gap between the outer lateral surface of the fixation cover part 230 and the inner lateral surface of the switch main body 210 may be greater than a gap between the support surfaces (part A and part B) of the tact switch part 240 and the inner lateral surface of the switch main body 210. Accordingly, in the case where the tact switch part 240 is pressed by the pressing part 222 of the rotating core part 220, a click feeling of the tact switch part 240 may be caused.

Additionally, in 120 section of the positions of part A and part B where the support surface of the tact switch part 240 is placed, formed is part C where the outer lateral surface of the fixation cover part 230 has a minimum gap with respect to the switch main body 210, in the radial direction. Accordingly, in the case where the tact switch part 240 has a support surface having a minimum gap with respect to the switch main body 210 in the radial direction, part C, together with part A and part B, evenly distributes a support force of the outer lateral surface of the fixation cover part 230 with respect to the inner lateral surface of the switch main body 210.

Accordingly, while the support force of the outer lateral surface of the fixation cover part 230 with respect to the switch main body 210 is evenly distributed, the click felling of the tact switch part 240 may be caused.

FIGS. 9 and 10 are plan views showing an operation state of the switching assembly for regulating a rotary load of the fitness bike in FIG. 6, FIG. 11 is a block diagram showing the configuration of control of a rotation resistance device of a fitness bike in an embodiment, and FIG. 12 is a flowchart showing a control method of a rotation resistance device of a fitness bike in an embodiment.

As illustrated in FIG. 6, before the operations of the first manipulation part 211 and the second manipulation part 212 of the switch lever 200, the pressing part 222 of the rotating core part 220 is placed in a normal state where the pressing part 222 does not switch to the tact switch part 240.

The user proceeds with a switch manipulation step of swiveling any one of the first manipulation part 211 and the second manipulation part 212 of the switch main body 210, with the user's thumb, to adjust a rotary load level of the stator 180 to a certain level. At this time, since the switch main body 210 is coupled to the lever assembly 300 by the shaft coupling part 312 through the rotating core part 220 as a medium, the switch main body 210 can rotate in any one lateral direction (S10).

As shown in the drawing, in the case where the second manipulation part 22 of the switch main body 210 is manipulated in the clockwise direction or the counterclockwise direction, the pressing part 222 of the rotating core part 220 presses the tact switch part 240 disposed at the fixation cover part 230, while the pressing part 222 of the rotating core part 220 rotates together with the swiveling shaft part 221 (S20). At this time, at a time of the pressing operation of the tact switch part 240, the elastic member 250 connecting to the swiveling shaft part 221 of the rotating core part 220 applies an elastic restoring force in a direction opposite to the rotation direction of the switch main body 210, in the state where the elastic member 250 is elastically supported by the lever assembly 300 at the same time as the elastic member 250 elastically supports the switch main body 210.

A main controller 500 recognizes a pressing operation of the tact switch part 240 as a signal for regulating a rotary load level of the flywheel 170, and delivers a rotary load control signal to an EMS controller 600 that gradually controls the stator 180 as a resistor increasing or decreasing a rotary load of the flywheel 170 (S30).

The EMS controller 600 detects a tact switch part 240 to which a control signal is transmitted, among the tact switch parts 240, to determine a rotation direction of the switch main body 210. That is, the EMS controller 600 determines whether the control signal is a signal for gradually increasing a rotary load level of the flywheel 170 or a signal for gradually decreasing a rotary load level of the flywheel 170. For example, as illustrated in FIG. 9, a clockwise rotation operation of the switch main body 210 may be a signal for gradually increasing a rotary load level, and as illustrated in FIG. 10, a counterclockwise rotation operation of the switch lever 200 may be a signal for gradually decreasing a rotary load level.

The EMS controller 600 regulates the intensity of a magnetic force of the stator 180 depending on whether a rotary load of the flywheel 170 increases or decreases, to give a resistance value relevant to the rotary load to the flywheel 170 (S40).

Additionally, the switch lever 200 at both sides of the handle part 143 sets a resistance value respectively for rotary loads of different magnitude, to allow the user to freely control a width in relation to a rotary load. For example, the switch lever 200 at one side of the handle part 143 may control the resistance value of a rotary load, based on one unit, and the switch lever 200 at the other side of the handle part 143 may control the resistance value of a rotary load, based on 10 units. That is, the resistance value of a rotary load increases or decreases based on one unit, or 10 units (S50).

In the case where the pressing operation of the tact switch part 240 is undone, the elastic member 250 connecting to the swiveling shaft part 221 of the rotating core part 220 applies an elastic restoring force in a direction opposite to the rotation direction of the switch main body 210, the elastic member 250 returns to an original state because of the elastic restoring force.

In the embodiment, a switch for regulating a rotary load may be disposed on the handle part 143, and in the state of gripping the handle part, the user may readily manipulate a rotary load level during a ride exercise, while the user's hands are prevented from escaping from the handle part 143.

According to the present disclosure, the rotary load level increases or decreases to be adjusted based on the one-touch manipulation of the switch for regulating a rotary load in both directions, making it possible to gradually increase or decrease a rotary load of the flywheel 170.

According to the present disclosure, a plurality of welding points is formed in the portion where the upper handle 401 and the lower handle 402 of the handle part 143 are coupled to the switch for regulating a rotary load, making it possible to ensure the rigidity of the handle part 143 provided with the switch for regulating a rotary load to which a large load is applied.

According to the present disclosure, the first manipulation part 211 and the second manipulation part 212 of the switch main body 210 are elongated in the direction where the first manipulation part 211 and the second manipulation part 212 face each other, at the handle pipe 400, making it possible for the user to manipulate the first and second manipulation parts 211, 212 readily with the user's finger in both directions, in the state where the user grips the handle part 143 under the switch lever 200.

According to the present disclosure, a fastening tool of the switch lever 200, coupled to the handle part 143, is not in the user's vision at a maximum level, making it possible to improve the exterior of the fitness bike 1 and a level of completion in design of the fitness bike 1.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the range of the disclosure though not explicitly described in the description of the embodiment.

The invention claimed is:

1. A switch assembly for regulating a rotary load of a fitness bike, the switch assembly comprising:

a switch main body being rotatably assembled to a handle pipe;

a rotating core part having a same rotation center as the switch main body, being rotatably disposed, and being elastically restoring together with the switch main body;

a fixation cover part having an outer lateral surface that supports an inner lateral surface of the switch main body, and an inner lateral surface that supports an outer lateral surface of the rotating core part; and a tact switch part being disposed at two ends of the fixation cover part, and operating based on a pressing operation that is caused by a rotation of the rotating core part.

2. The switch assembly of claim 1, wherein the switch main body is rotatably coupled to the handle pipe in a circumferential direction thereof by a lever assembly that is inserted into a hollow hole of the handle pipe.

3. The switch assembly of claim 2, wherein the switch main body comprises a first manipulation part and a second manipulation part that protrude outward respectively within a predetermined angle range.

4. The switch assembly of claim 2, the lever assembly, comprising:

an assembly main body, comprising:

an insertion groove part being inserted into the hollow hole of the handle pipe, and being formed concavely along the circumferential direction where the switch main body is inserted; and a shaft coupling part being shaft-coupled to the rotating core part, to allow the switch main body to rotate along the insertion groove part.

5. The switch assembly of claim 4, the rotating core part, comprising:

a swiveling shaft part having a circular cross section and being fixed to the shaft coupling part of the lever assembly; and a pressing part being elongated from the swiveling shaft part and being supported by the switch main body.

6. The switch assembly of claim 5, wherein an elastic member exerting an elastic restoring force connects to a lower end of the swiveling shaft part of the rotating core part.

7. The switch assembly of claim 1, wherein the switch assembly further comprises a main controller recognizing the pressing operation of the tact switch part as a signal for regulating a rotary load level of a flywheel of the fitness bike, and delivering a rotary load control signal for regulating the rotary load to an EMS controller that controls a resistor increasing or decreasing the rotary load to the flywheel.

8. The switch assembly of claim 7, wherein the EMS controller determines whether a level of the rotary load to the flywheel increases or decreases, and based on an increase or a decrease in the rotary load to the flywheel, adjusts intensity of a magnetic force of the resistor, and gives a resistance value in relation to the rotary load to the flywheel.

9. The switch assembly of claim 8, wherein the resistor is comprised of a stator.

10. A fitness bike, comprising:

a switch lever, comprising:

a switch main body being rotatably assembled to a handle pipe, and being provided with a first manipulation part and a second manipulation part that protrude outward respectively within a predetermined angle range;

a rotating core part being concentric to the switch main body, and rotating in a way that the rotating core part is elastically restored together with the switch main body;

a fixation cover part supporting an inner lateral surface of the switch main body and supporting an outer lateral surface of the rotating core part;

a tact switch part being disposed at two ends of the fixation cover part, and switching based on a rotation of the rotating core part; and an elastic member being disposed at a lower end of the rotating core part, and applying an elastic restoring force to the rotating core part.

11. The fitness bike of claim 10, wherein the handle pipe has a rectangle shape in a way that an upper handle of an inverted "U" shape, and each of lower handles of a "∟" shape are combined.

12. The fitness bike of claim 10, wherein the switch lever is elongated in a direction where the first manipulation part and the second manipulation part of the switch main body face each other, at the handle pipe.

13. The fitness bike of claim 10, wherein the fitness bike further comprises a main controller recognizing a pressing operation of the tact switch part as a signal for regulating a rotary load level of a flywheel of the fitness bike, and delivering a rotary load control signal for regulating a rotary load to an EMS controller that controls a resistor increasing or decreasing the rotary load to the flywheel.

14. The fitness bike of claim 13, wherein the EMS controller determines whether a level of the rotary load to the flywheel increases or decreases, and based on an increase or a decrease in the rotary load to the flywheel, adjusts intensity of a magnetic force of the resistor, and gives a resistance value in relation to the rotary load to the flywheel.

15. The fitness bike of claim 14, wherein the resistor is comprised of a stator.

* * * * *